United States Patent [19]

Breslin

[11] 4,272,080

[45] Jun. 9, 1981

[54] EDUCATIONAL BOARD GAME

[76] Inventor: Edward P. Breslin, 5103 N. 15th St., Philadelphia, Pa. 19141

[21] Appl. No.: 46,473

[22] Filed: Jun. 7, 1979

Related U.S. Application Data

[63] Continuation of Ser. No. 833,979, Sep. 16, 1977, abandoned.

[51] Int. Cl.[3] ..... A63F 3/00

[52] U.S. Cl. ..... 273/249

[58] Field of Search ..... 273/243, 248, 249, 246, 273/251, 252, 254, 257

[56] References Cited

U.S. PATENT DOCUMENTS

| | | | |
|---|---|---|---|
| 1,208,992 | 12/1916 | Leonard | 273/249 |
| 1,635,734 | 7/1927 | Ziegler | 273/249 |
| 2,178,330 | 10/1939 | Thomas | 273/256 |
| 2,223,175 | 11/1940 | Ink | 273/243 |

*Primary Examiner*—Richard C. Pinkham

*Assistant Examiner*—Carl Moy

*Attorney, Agent, or Firm*—Weiser, Stapler & Spivak

[57] ABSTRACT

An educational game designed to acquaint the players with a particular subject includes a gameboard and tokens representing the different players movable thereon. The gameboard is divided to include a plurality of separate paths, and each path is further subdivided into discrete spaces. These spaces include indicia thereon providing different types of data relating to the subject of the game, and each space includes a numerical marking indicating its position, or location, within its path. A move director apparatus, such as dice, operable by the players to determine, on the basis of chance, the number of spaces within a particular path that the tokens should be moved. An informational aid separate from the board includes both general information about the specific data in the spaces, and questions relating to the particular subject of the game. Preferably a scoreboard, and scoreboard markers are provided to keep track of each player's score as the game progresses.

7 Claims, 6 Drawing Figures

EDUCATIONAL BOARD GAME

This is a continuation, of application Ser. No. 833,979, filed Sept. 16, 1977 and since abandoned.

BACKGROUND OF THE INVENTION

This invention is directed to an educational game, and more specifically, to an educational board game of the type employing tokens representing the different players, and a gameboard on which the tokens are movable.

Board games, as a class, are extremely popular, and have been employed in the educational game field. For example, see U.S. Pat. No. 1,635,734, issued to Ziegler. Educational games, to be effective, should be simple to play, should be capable of acquainting the players with various different areas of a particular subject, and should be capable of reinforcing the learning experience. Although the Ziegler game, may, to some extent, have one or more of these desired attributes, improvement is always desirable. It is to an improved educational board game that the present invention is directed.

SUMMARY OF THE INVENTION

An educational board game designed to acquaint the players with a particular subject includes a gameboard that is divided to include a plurality of separate paths and tokens representing the different players which are movable along these paths. Each path is subdivided into discrete spaces, and indicia providing data relating to the subject of the game is included in these spaces. Preferably the type of data in the spaces varies from path to path so that the manner in which the subject of the game is "taught", i.e. the particular area of the subject being emphasized, will depend upon the particular path being played. Therefore, by playing the game along the different paths, different areas of the subject of the game will be emphasized.

A move director means, such as dice, is operable by the players to determine, on the basis of chance, the number of spaces within a particular path that the tokens should be moved. An informational aid, which can be in the form of a booklet, includes general information relating to the data in the various spaces, and also includes questions about the subject of the game. These questions are keyed to numerical markings in the various spaces, and the numerical markings indicate the relative position of the spaces within their respective paths. The players can be required to give general information relating to the data in the spaces, and also to answer questions keyed to these spaces. This provides a unique arrangement for reinforcing the learning experience.

In the preferred form of this invention, scoreboard markers representing different players, are movable on a scoreboard to keep track of each player's score in an easily discernible manner.

It is an object of the invention to provide an improved, educational board game of the type set forth.

It is another object of this invention to provide a novel educational board game to teach a subject in a simple and enjoyable manner.

It is a further object of this invention to provide a novel educational board game to teach various different areas of a subject.

It is a further object of this invention to provide a novel educational board game to teach a subject in a manner that reinforces the learning experience.

It is a further object of this invention to provide an educational board game for teaching a subject.

It is a further object of this invention to provide an educational board game that is simple in both construction and mode of operation.

Other objects and a fuller understanding of the invention will be had by referring to the following description and claims of a preferred embodiment thereof, taken in conjunction with the accompanying drawings, wherein like reference characters refer to similar parts through the several views, and in which:

DESCRIPTION OF THE PREFERRED EMBODIMENT OF THE INVENTION

Figure 1:
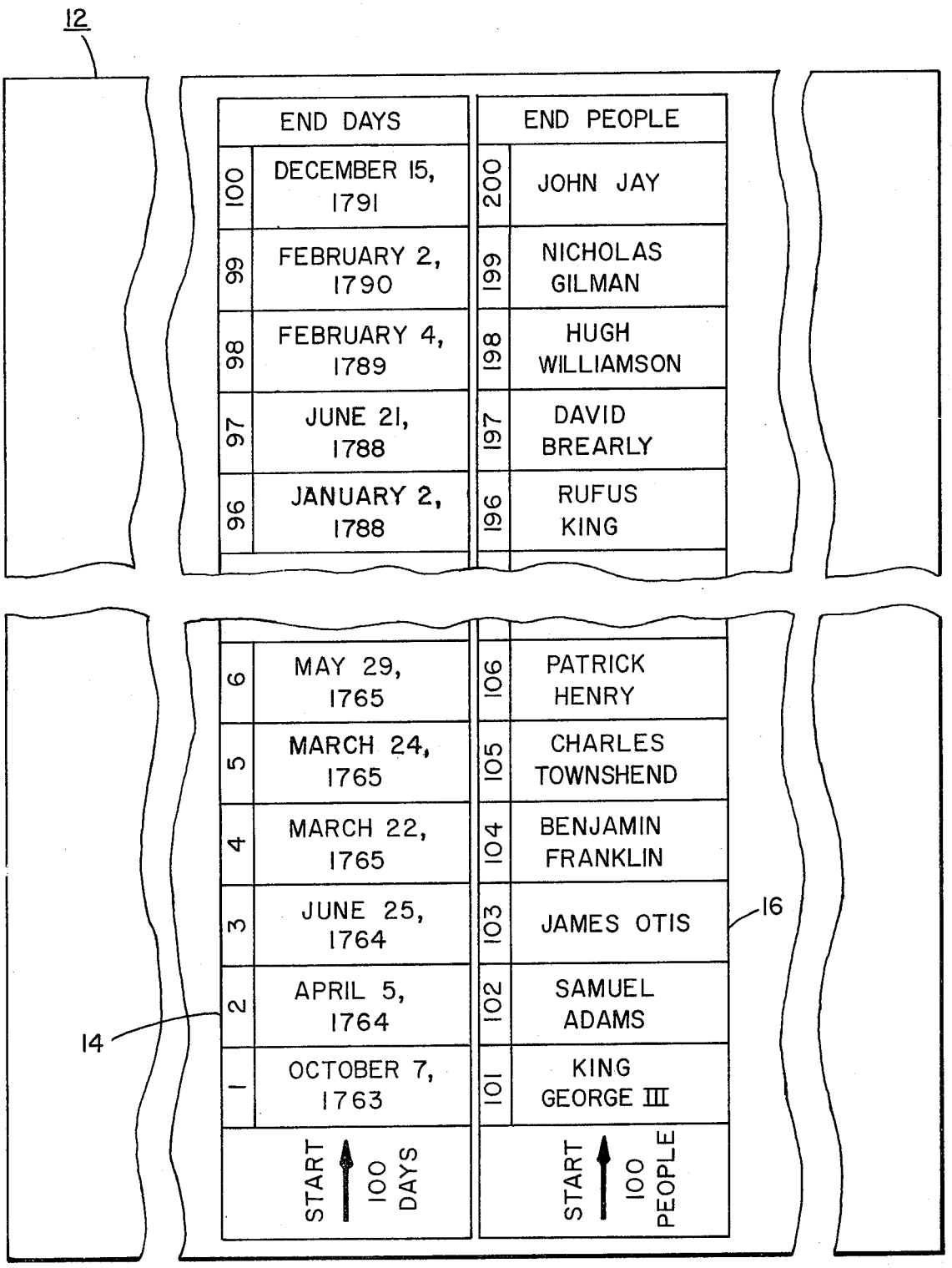
FIG. 1 is a fragmentary plan view of the gameboard employed in the educational game of this invention.

Although specific terms are used in the following description for the sake of clarity, these terms are intended to refer only to the particular embodiment of the invention selected for illustration in the drawings, and are not intended to define or limit the scope of the invention.

The educational board game illustrated herein for purposes of example is directed to the subject of American Revolution. It will be appreciated that other subject matters could be employed with equal facility and would be within the meaning and scope of this invention.

Referring to FIG. 1, the educational board game includes a gameboard 12 divided into two separate paths 14 and 16. Each of these paths is further subdivided into separate spaces; one hundred of such spaces, for example, being provided in each of the paths 14 and 16. The spaces in path 14 are provided with sequential numerical markings from 1 to 100 to indicate their relative position within the path 14. In a like manner, the spaces in path 16 are provided with sequential numercial markings from 101 through 200 to indicate their relative position within the path 16. As can be seen in FIG. 1, the paths are preferably arranged parallel to each other so that each of the spaces in one path is aligned with a space of the other path, and so that the "START" and "END" spaces are also laterally aligned.

In the embodiment shown in FIG. 1 the one hundred spaces of path 14 are provided with famous dates relating to the American Revolutionary period. The one hundred spaces in the path 16 are provided with the names of one hundred noteworthy individuals that had some relationship to the American Revolutionary period. If desired, the paths 14 and 16 can be interrupted at various locations to provide regions on the board 12 for pictures and other artistic information; however, these additional features are not actually employed in playing the game.

Figure 2:
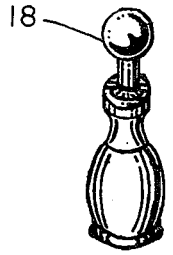
FIG. 2 illustrates a token representing a player of the game.
Figure 3:
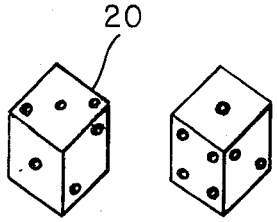
FIG. 3 represents a pair of dice for determining, on the basis of chance, the movement of the tokens along the gameboard.

The game preferably is played by two, three or four players, and is provided with four tokens, each being a different color, or otherwise coded to represent the different players. A representative token is shown at 18 in FIG. 2. Movement of the tokens along the paths 14 and 16 is determined, on the basis of chance, by the roll of dice 20 (FIG. 3). When only two players are participating in the game, preferably only one die is employed to determine the number of spaces along a particular path that the tokens should be moved.

Figure 4:
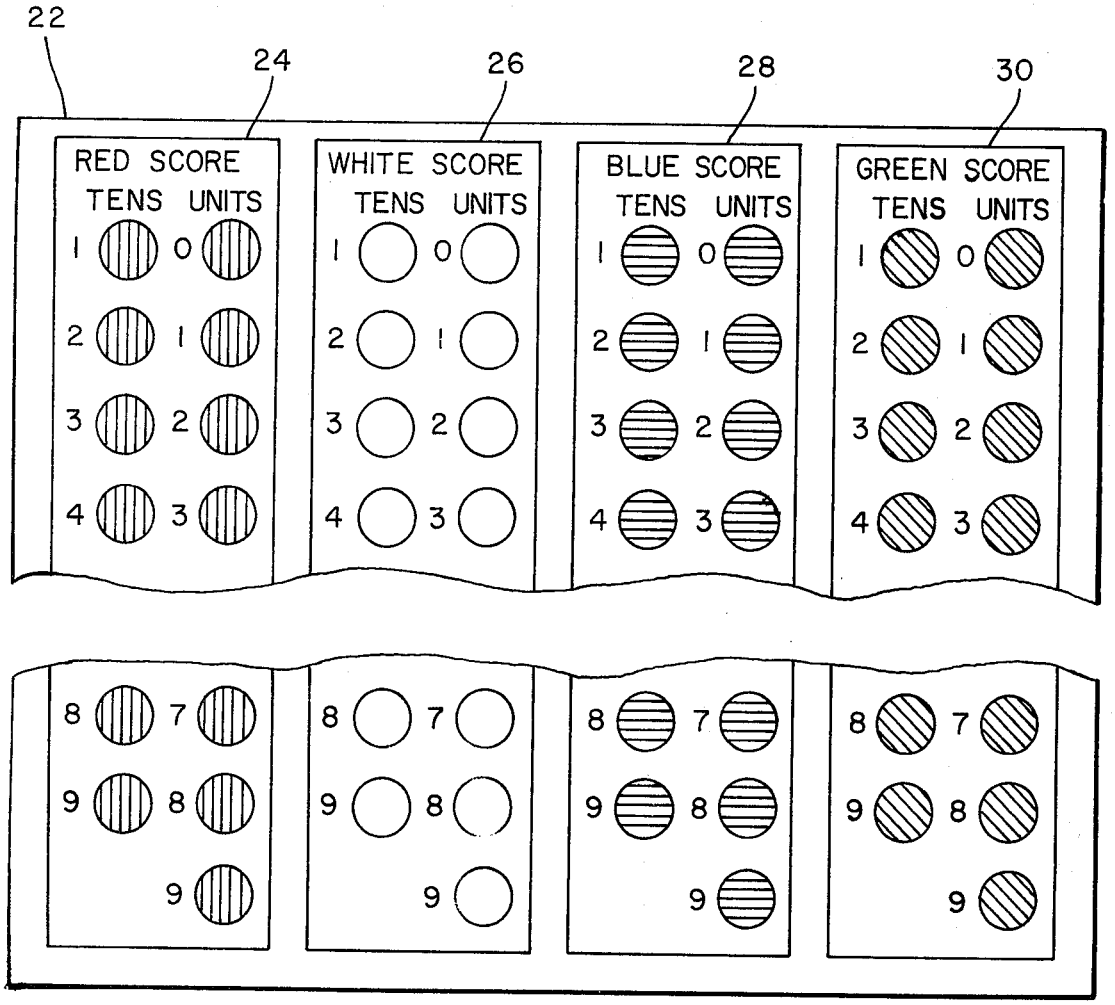
FIG. 4 is a fragmentary plan view of a scoreboard utilized in this invention.

Referring to FIG. 4, a scoreboard 22 is illustrated and includes four separate scoring areas 24, 26, 28 and 30. Each of these scoring areas can be used to keep the score of one player. Thus the scoreboard 22 can be used to keep the score of up to four players.

Each scoring area 24, 26, 28 and 30 is subdivided into a "UNITS" column and a "TENS" column. Each of these columns is formed by a series of circles that preferably are color coded to match the colors of the tokens. For example, a player using the red token will keep track of his score in area 24, and the circles in the UNITS and TENS columns in area 24 are red. In a like manner, the colors of the other tokens are matched with the colors of the circles in the remaining scoring areas 26, 28 and 30.

Figure 5:
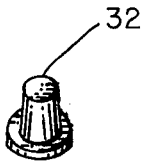
FIG. 5 illustrates a scoreboard marker for use in keeping the players' scores.

In order to keep track of the score four pairs (a total of 8) of scoreboard markers are provided. A representative marker is shown at 32 in FIG. 5. The markers of each pair are the same color, and differ in color from the other pairs of markers. To make it easy to identify the score of each player, the color of each pair of markers is the same as the color of one of the tokens and the colors of the circles in one of the scoring areas. For example, the player with the red token keeps score with two red scoreboard markers on the red scoreboard circles provided in area 24. In a like manner, the other players keep score with their markers in the appropriate scoring area. As can be seen in FIG. 5, the scoreboard 22 is capable of tallying a total score of "99" for each player.

The scoreboard 22 is provided to keep a record of correct answers by the players as they move their tokens along either of the two paths 14 or 16 on the gameboard 12. In the preferred method of play each correct answer is worth one point.

Figure 6:
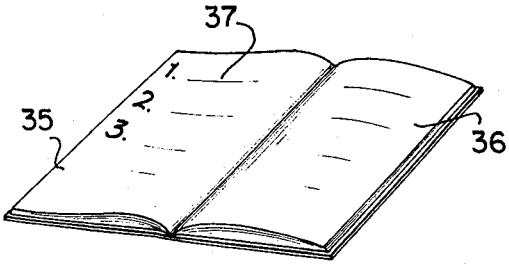
FIG. 6 illustrates a brochure which serves as an informational aid for use in playing the educational game of this invention.

As illustrated in FIG. 6, the educational board game also includes an informational aid, preferably in the form of a brochure 35, containing both information 36 and questions 37 relevant to the American Revolutionary period. Specifically, the informational aid includes general information relating to each of the dates set forth in spaces 1–100 in path 14, and relating to each of the names set forth in spaces 101–200 in path 16. This information preferably is keyed to the sequential numerical markings (1 through 200) provided at the left margin of the spaces, as shown in FIG. 1. In a like manner, the informational aid contains questions relating to the American Revolutionary period; a question being keyed to each of the numbers 1 through 200. These questions do not necessarily have any relationship to the particular data contained in the space. However, in the most preferred embodiment of this invention, the answers to the questions that are keyed to the sequential markings 1 through 100 can be found in the general information relating to one of the dates in path 14. For example, the question that is keyed to the space numbered "2" could have an answer that is contained in the general information associated with any one of the spaces 1 through 100. This provides an excellent way of reinforcing the learning experience, as will be explained hereinafter in connection with the manner of playing the game.

The object of this game is to get the highest score by giving correct "information" in round 1 and correctly answering "questions" in round 2 as the players move their tokens along one of the paths 14, 16 in response to the number rolled with the dice 20. Each complete game is played along only a single path 14 or 16, and each game consists of the two rounds described above. The manner in which the players choose to play either the "100 Days" path or the "100 People" path is purely arbitrary, and can be determined, for example, by the player rolling the highest number with the dice 20. The players position their tokens in the START space of the particular path being played and the first player (determined in any desired manner) rolls the dice (or die), and moves the number of spaces indicated thereon. He is then required to make a statement about the particular data in the space. For example, the space numbered "2" contains the data Apr. 5, 1764. Therefore, if the game is being played along path 14, and a player rolls the number 2 on the dice, he will move into this space and be required to make a statement about the date. The player to the right will use the informational guide to determine whether the statement is accurate. In the example set forth the general information keyed to the space number 2 states the following:

"2. Apr. 5, 1764. The Sugar Act of 1733 never before enforced, is now set for enforcement. This calls for a three cent a gallon tax on molasses imported from countries outside British control."

If the player makes a correct statement, he receives one point. Each player proceeds in turn to move along the path being played and attempts to make a statement about the data in the space he lands on until each player has moved through all 100 spaces. If a roll of the dice (or die) takes a player beyond the END space of the path being played, the token will be stopped on the last numbered space in the path (i.e. 100 in path 14 and 200 in path 16) and the player will be required to make a statement about the data in that space in order to score a final point for the "information" round. The score of each player will be kept on the scoreboard 22 with the scoreboard markers, as discussed earlier.

The second round is played on the same path as the first round; however, in this case, each player will be asked a multiple choice question that is keyed to the sequential, numerical markings to the left of the spaces. The questions that are keyed to these markings are not necessarily related to the data contained in the spaces. For example, the question associated with space number 2 in path 14 is the following:

"2. Why did Benjamin Franklin go to London in February 1776?
(a) To protest the Stamp Act.
(b) To protest immigration laws.
(c) To protest voting requirements imposed on the Colonies."

The correct answer to this question is (a), which bears absolutely no relationship to the information about the Apr. 5, 1764 date set forth in space number 2. The information relating to the Apr. 5, 1794 date was set forth earlier in this application.

In the preferred form of this invention the answers to the questions associated with the sequential markings 1 through 100 are contained in the general information relating to the dates in these spaces. For example, the answer to the question that is keyed to space number 2 can be found in the general information relating to the date set forth in space number 9. The general information relating to this date is as follows:

"9. Feb. 13, 1776. Benjamin Franklin appears in the British House of Commons to appeal for repeal of the Stamp Act."

It was later repealed because of this, and because it cost more to collect that it produced."

The informational aid also includes an answer section showing the correct answers to the questions associated with each of the serially numbered spaces. Most preferably the answer section also keys the answer to the informational statement containing that answer. For example, the answer section, in providing information relating to the question associated with space number 2, reads as follows:

| QUESTION | ANSWER | CROSS-REFERENCE |
|---|---|---|
| 2 | (a) | 9 |

This indicates that the correct answer to the question associated with space number 2 is choice (a), and that this answer can be found in the general information relating to the date set forth in the space numbered 9.

The question round is scored in the same way as the information round. Specifically, each time a player answers a correct question he is given one point. Also, the question round is terminated in the same manner as described above in connection with the information round. The player with the highest total points after both rounds is the winner.

As should be apparent from the above discussion, that when the players are playing path 14 they are approaching the subject of the American Revolutionary period from the standpoint of historical dates. However, when they are playing path 16, they are approaching the subject from the standpoint of noteworthy people. Thus, different aspects of the American Revolutionary period are emphasized in the different paths 14 and 16.

In addition, in playing each of the paths 14, 16, the players are exposed to an "information" round and a "question" round. Accordingly, within each path the players are exposed to the subject of the American Revolution by two different teaching techniques. This tends to reinforce the learning experience. The multiple approaches to acquiring information about the American Revolutionary period afforded by the educational board game of this invention provides a unique learning experience in an extremely simple and understandable manner.

Although the invention has been described with a certain degree of particularity, it is understood that the present disclosure has been made only by way of example, and that numerous changes in the details of construction and the combination and arrangement of parts may be resorted to without departing from the scope of the invention.

What is claimed is:

1. An educational board game relating to a particular subject and being played with tokens representing the different players, said game comprising:

a game board being divided to include a plurality of separate paths, at least two of which are adjacent to each other, said tokens being movable along any one of said paths;

each path being divided into discrete spaces, each space in one of said two adjacent paths being adjacent to a space in the other of said two adjacent paths, and each of said spaces having indicia imprinted thereon, wherein the printed indicia of adjacent pairs of spaces do not relate to each other, and wherein the printed indicia of each said spaces comprises written information containing different types of data relating to the subject of the game, each space further including one of a sequential number to indicate its position within its respective path;

move directing means operable by the players to determine, on the basis of chance, the number of spaces within a path that the tokens should be moved; and an informational aid which relates to and provides information about the printed indicia of the spaces, said informational aid comprising a plurality of sets of information items, one set for each path, each set having as many members as there are spaces on the respective path, each member of said sets comprising information relating to the indicia printed on the corresponding space on said path, said information aid further comprising a plurality of sets of questions, one set for each path, each member of each set of questions relating to the subject matter found on a space in the corresponding path other than the space corresponding to said member.

2. The educational board game of claim 1 further comprising scoring means on the game board, said scoring means being capable of indicating the score of a player, which scoring means is subdivided into two columns, each having a plurality of subdivisions which are used to indicate said score, one column indicating digits and the other indicating tens, which markers are placed upon said subdivisions to indicate the score of said players.

3. The educational board game of claim 1 wherein the markers, tokens and subdivisions are colored and wherein the colors are coordinated in order to correspond respectively whereby the score of an individual player can be readily indicated and determined.

4. The educational board game of claim 1, wherein the indicia of the spaces of a given path relate to essentially the same subject matter, and to subject matter at least slightly different from that of the spaces of any other paths.

5. The educational board game of claim 4, wherein any one of said paths can be used to play the game, without the use of any of the other paths.

6. The educational board game of claim 5, wherein the game is adapted for teaching different subject areas, depending on the choice of paths used for playing the game.

7. The educational board game of claim 1, the game being designed for playing two rounds, the first round involving the sets of information items, and the second round involving the sets of questions.

* * * * *